US007865971B1

(12) United States Patent
Kileb

(10) Patent No.: US 7,865,971 B1
(45) Date of Patent: Jan. 11, 2011

(54) CHILD BIB NECK STRAP EXTENSION ASSEMBLY

(76) Inventor: Gregory G. Kileb, 2 Lawrence St., Bay Park, NY (US) 11518

( * ) Notice: Subject to any disclaimer, the term of this patent is extended or adjusted under 35 U.S.C. 154(b) by 0 days.

(21) Appl. No.: 12/394,266

(22) Filed: Feb. 27, 2009

(51) Int. Cl.
*A41B 13/10* (2006.01)

(52) U.S. Cl. ..... 2/52; 2/49.1

(58) Field of Classification Search ..... 2/48, 2/49.1–49.5, 51, 52, 50, 92, 104, 336, 338–340, 2/67, 463, 46, 102, 44, 114, 75, 80, 106, 2/109, 110, 304, 315, 323; 24/3.4, 3.1, 3.13, 24/7, 9, 38; D2/861–864; 224/578, 579, 224/580, 257, 258, 259; 450/77, 82
See application file for complete search history.

(56) References Cited

U.S. PATENT DOCUMENTS

| | | | | | |
|---|---|---|---|---|---|
| 1,016,444 | A | * | 2/1912 | Schmidt | 2/92 |
| 1,095,476 | A | * | 5/1914 | Sprague | 2/80 |
| 1,389,689 | A | * | 9/1921 | Parker | 2/48 |
| 1,564,897 | A | * | 12/1925 | Sanborn | 2/48 |
| 1,821,185 | A | * | 9/1931 | Michael | 2/74 |
| 2,423,002 | A | * | 6/1947 | Bray | 2/52 |
| 2,468,841 | A | * | 5/1949 | Siegel | 2/463 |
| 2,585,689 | A | * | 2/1952 | Schafer | 2/127 |
| 2,602,929 | A | * | 7/1952 | Chasinov | 450/82 |
| 2,820,269 | A | * | 1/1958 | Wolff | 24/9 |
| 2,821,716 | A | * | 2/1958 | Salter, Jr. | 2/116 |
| 2,835,895 | A | | 5/1958 | Wells | |
| 2,945,614 | A | * | 7/1960 | Wittmann | 224/148.7 |
| 3,350,720 | A | * | 11/1967 | Freund | 2/48 |
| 4,014,045 | A | * | 3/1977 | Moyer | 2/51 |
| 4,580,298 | A | * | 4/1986 | Tuisl | 2/237 |
| 4,803,740 | A | * | 2/1989 | Dawson | 2/215 |
| 5,220,692 | A | * | 6/1993 | Cox | 2/48 |
| 5,692,240 | A | | 12/1997 | Steele | |
| 5,842,228 | A | | 12/1998 | Krainin | |
| 5,956,762 | A | * | 9/1999 | Adams | 2/48 |
| 5,996,119 | A | | 12/1999 | Anderberg | |
| 6,122,771 | A | * | 9/2000 | Cook et al. | 2/48 |
| 6,141,799 | A | | 11/2000 | Morris | |
| 6,219,848 | B1 | * | 4/2001 | Russell | 2/221 |
| D443,404 | S | * | 6/2001 | Bramhan | D2/864 |
| 7,039,958 | B2 | | 5/2006 | Henricksen | |
| D548,129 | S | | 8/2007 | Fineide | |
| 2006/0117465 | A1 | | 6/2006 | Willows et al. | |
| 2007/0123148 | A1 | * | 5/2007 | Heer | 450/77 |

* cited by examiner

*Primary Examiner*—Amy B Vanatta

(57) ABSTRACT

A child bib neck strap extension assembly includes a panel having a bottom edge, a top edge, a first lateral edge and a second lateral edge. The panel has a neck receiving notch therein extending into the top edge and extending towards the bottom edge. A pair of strap portions of the panel is defined between the notch and associated ones of the first and second lateral edges. At least one fastener is attached to the panel to allow the strap portions to be releasably attached together. An elongated strap has a front side and a backside. A securing member is attached to the elongated strap and is releasably engageable with the at least one fastener to extend the elongated strap between and releasably secure the elongated strap to each of the strap portions to selectively increase an effective length of the strap portions.

2 Claims, 4 Drawing Sheets

CHILD BIB NECK STRAP EXTENSION ASSEMBLY

BACKGROUND OF THE INVENTION

Field of the Invention

The present invention relates to strap extension devices and more particularly pertains to a new strap extension device for extending the length of a bib's neck strap.

SUMMARY OF THE INVENTION

The present invention meets the needs presented above by generally comprising a panel that has a first side, a second side, a bottom edge, a top edge, a first lateral edge and a second lateral edge. The panel has a neck receiving notch therein extending into the top edge and extending towards the bottom edge. A pair of strap portions of the panel is defined between the notch and associated ones of the first and second lateral edges. The strap portions are attachable together and extendable around a neck of a child. At least one fastener is attached to the panel to allow the strap portions to be releasably attached together. An elongated strap has a first end, a second end, a front side and a backside. A securing member is attached to the elongated strap and is releasably engageable with the at least one fastener to extend the elongated strap between and releasably secure the elongated strap to each of the strap portions. The elongated strap is attached to the strap portions to selectively increase an effective length of the strap portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
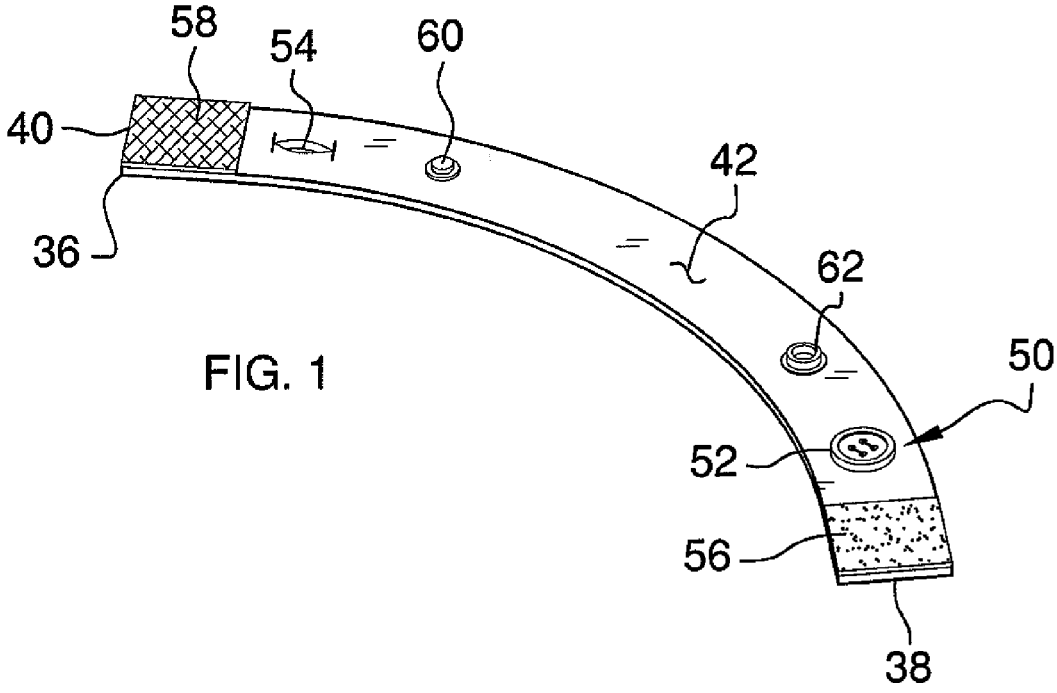
FIG. 1 is a front perspective view of a child bib neck strap extension assembly according to the present invention.
Figure 2:
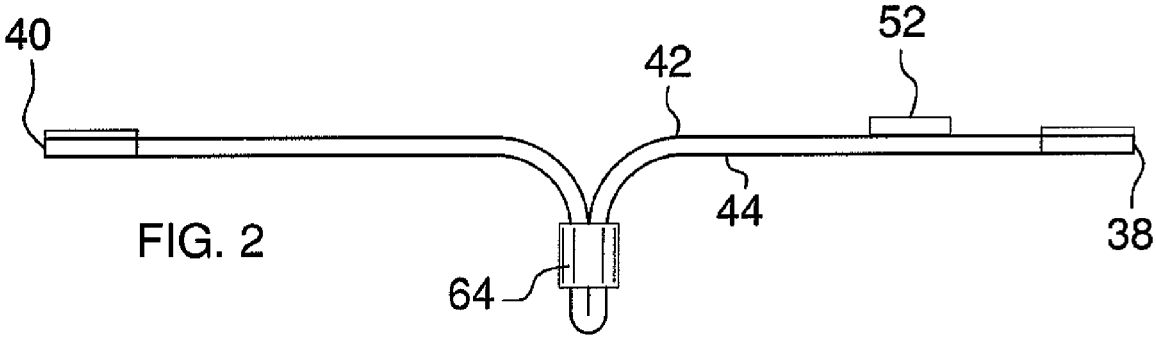
FIG. 2 is a top view of the present invention.
Figure 3:
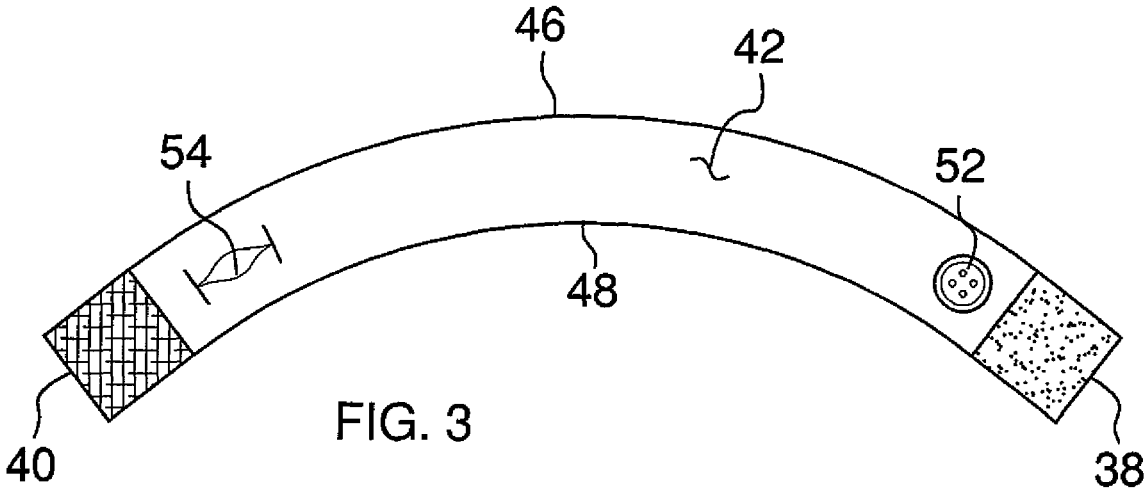
FIG. 3 is a front view of the present invention.
Figure 4:
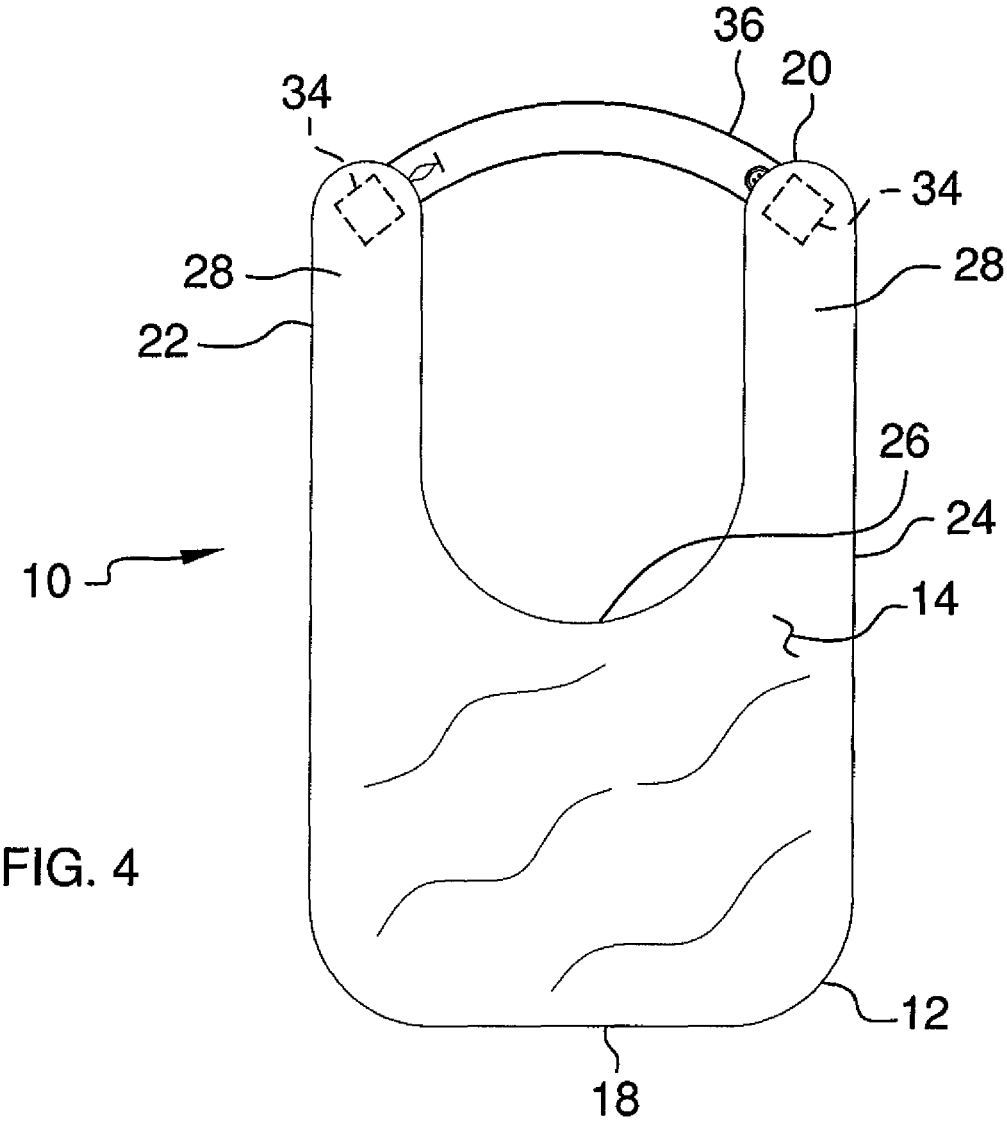
FIG. 4 is a front view of the present invention.
Figure 5:
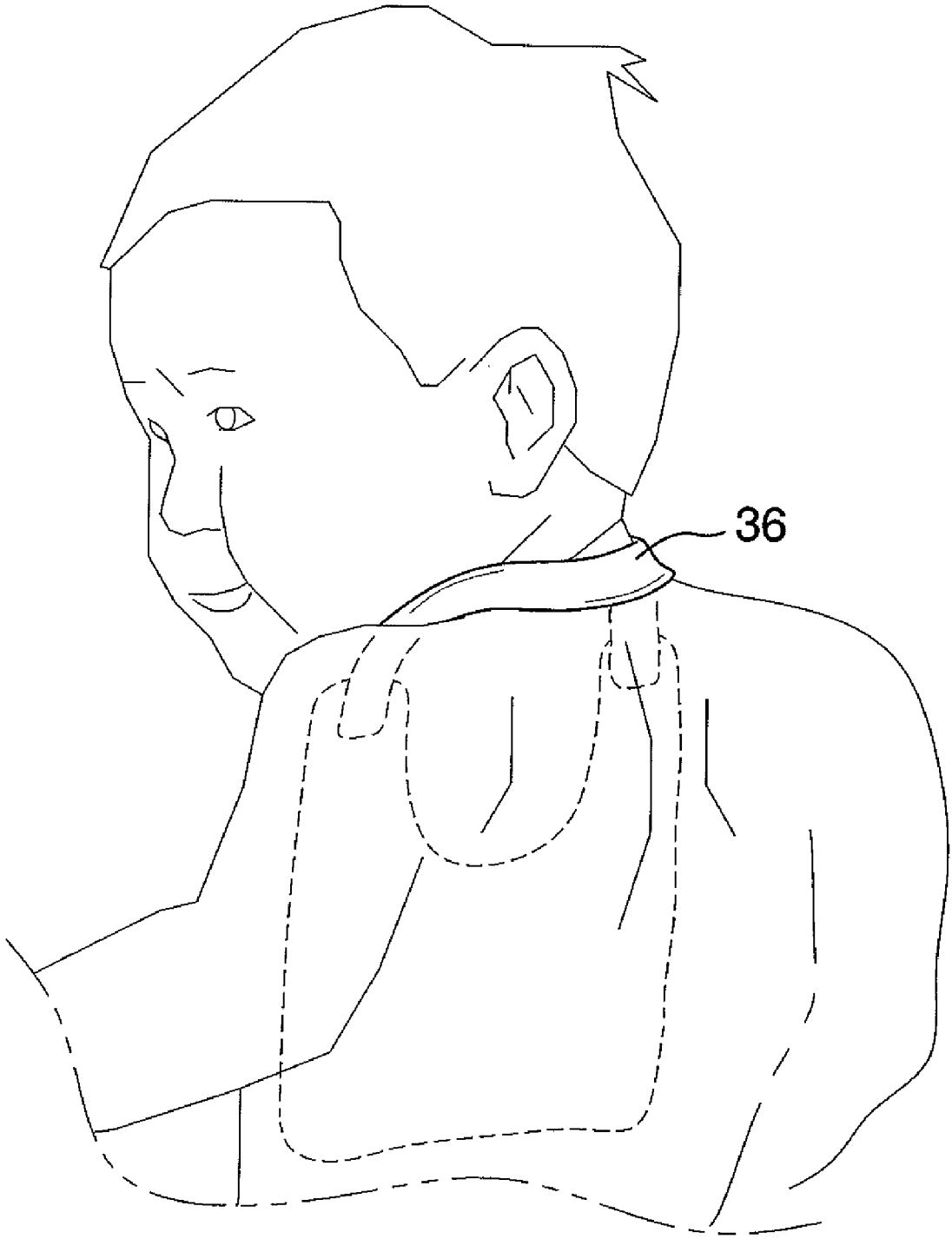
FIG. 5 is a perspective in-use view of the present invention.

With reference now to the drawings, and in particular to FIGS. 1 through 6 thereof, a new strap extension device embodying the principles and concepts of the present invention and generally designated by the reference numeral 10 will be described.

Figure 6:
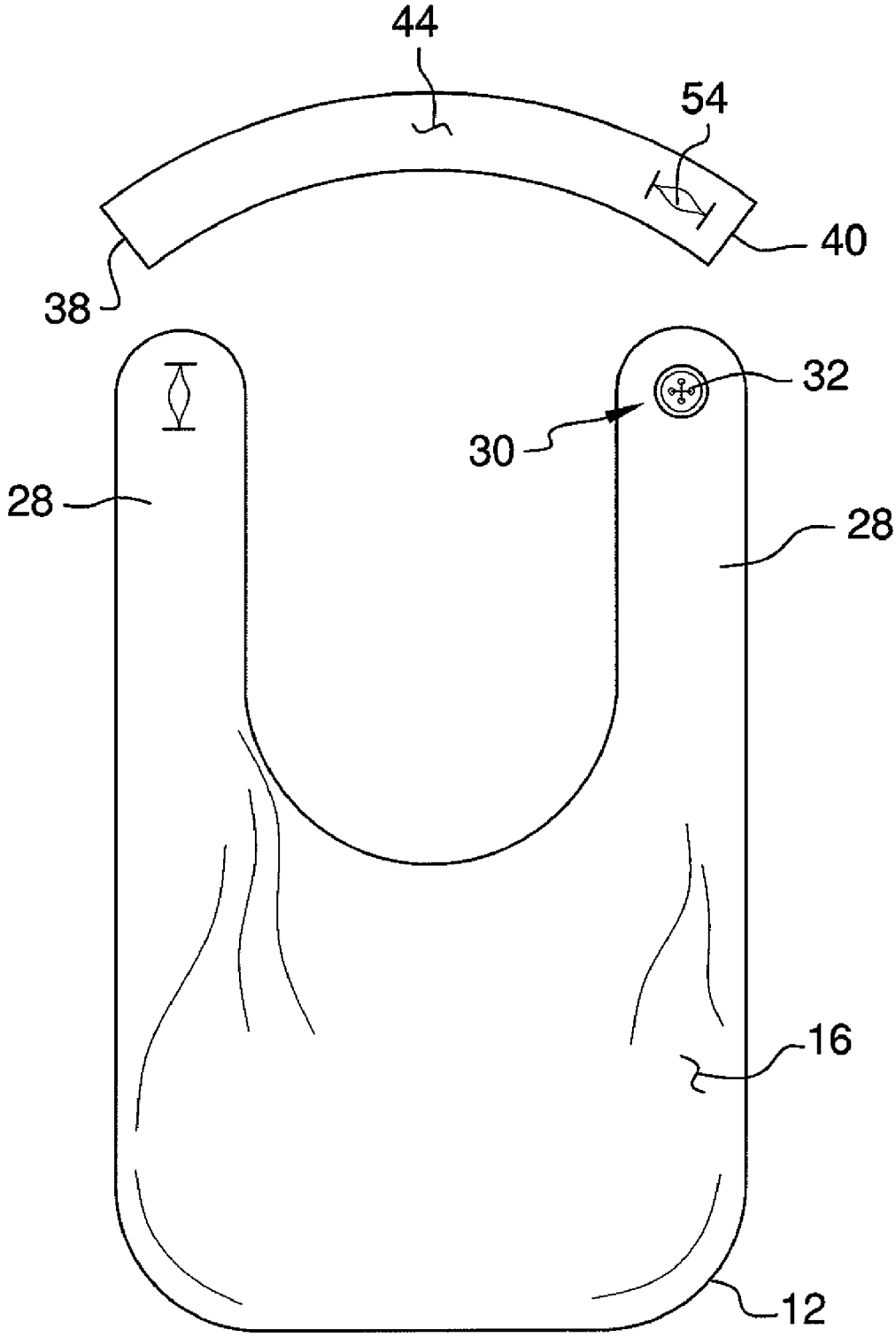
FIG. 6 is a rear view of the present invention.

As best illustrated in FIGS. 1 through 6, the child bib neck strap extension assembly 10 generally comprises a panel 12 made of cloth or flexible plastic material that has a first side 14, a second side 16, a bottom edge 18, a top edge 20, a first lateral edge 22 and a second lateral edge 24. The panel 12 has a neck receiving notch 26 therein extending into the top edge 20 and extending towards the bottom edge 18. A pair of strap portions 28 of the panel 12 is defined between the notch 26 and associated ones of the first 22 and second 24 lateral edges. The strap portions 28 are attachable together and extendable around a neck of a child. At least one fastener 30 is attached to the panel 12 to allow the strap portions 28 to be releasably attached together. The at least one fastener 30 may include any conventional fastening means used on bibs to secure the straps portions 28 thereof together. For instance, the at least one fastener may include a button 32 attached to one of the strap portions 28 and extendable into the other one of the strap portions 28 as shown in FIG. 6, mating portions 34 of a hook and loop coupler attached to the strap portions 28 as shown in phantom in FIG. 4, or male and female portions of a snap fastener attached to the strap portions.

An elongated strap 36 has a first end 38, a second end 40, a front side 42 and a backside 44. The elongate strap 36 has a length from the first end 38 to the second end 40 between 2 inches and 6 inches and may have a width between first 46 and second 48 side edges between ¼ inch and 1 inch. The first 46 and second 48 side edges may be arcuate. The elongated strap 36 may be comprised of any suitable, flexible material typically used for neck straps.

A securing member 50 is attached to the elongated strap 36 and is releasably engageable with the at least one fastener 30 to extend the elongated strap 36 between and releasably secure the elongated strap 36 to each of the strap portions 28. The securing member 50 may include a button 52 attached to the front side 42 of the elongated strap 50 and positioned nearer to the first end 38 than the second end 40. The elongated strap 36 has an opening 54 extending into the front side 42 and outwardly of the backside 44. The opening 54 is positioned nearer to the second end 40 than the first end 38. The button 52 and opening 54 are used when the bib, or panel 12, uses a button 32 type fastener. The securing member 50 may instead or further include a hook and loop securing combination including a first mating member 56 attached to the front side 42 and is positioned adjacent to the first end 38 and a second mating member 58 is attached to the front side 42 and is positioned adjacent to the second end 40. The hook and loop securing combination may be used when the fastener on the bib is also a hook and loop coupler 34. Alternatively, or in addition to that being stated above and as shown in the embodiment presented in FIG. 1, the securing member 50 may include male 60 and female 62 snap portions.

An adjustment member 64 is positioned on the elongate strap 36 to selectively alter a length of the elongate strap 36. The adjustment member 64 may include a loop or a clip positioned on the elongated strap 36 to bind a portion of the elongated strap and reduce a distance between the first 38 and second 40 ends.

In use, the elongated strap 36 is attached to the strap portions 28 to selectively increase an effective length of the strap portions 28. This allows bibs, having small strap portions, to be more easily extended around the neck of child. Additionally, it increases the life of a bib which a child would otherwise grow out of after the neck of the child has increased as the child grows.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bib and extension combination assembly comprising:

a panel having a first side, a second side, a bottom edge, a top edge, a first lateral edge and a second lateral edge, said panel having a neck receiving notch therein extending into said top edge and extending towards said bottom edge, a pair of strap portions of said panel being defined between said notch and associated ones of said first and second lateral edges, said strap portions being attachable together and extendable around a neck of a child, at least one fastener being attached to said panel to allow said strap portions to be releasably attached together;

an elongated strap having a first end, a second end, a front side and a backside;

a securing member being attached to said elongated strap and being releasably engageable with said at least one fastener to extend said elongated strap between and releasably secure said elongated strap to each of said strap portions, said securing member including;

a button attached to said front side of said elongated strap and being positioned nearer to said first end than said second end, said elongated strap having an opening extending into said front side and outwardly of said backside, said opening being positioned nearer to said second end than said first end;

a hook and loop securing combination including a first mating member attached to said front side and being positioned adjacent to said first end and a second mating member being attached to said front side and being positioned adjacent to said second end; and wherein said elongated strap is attached to said strap portions to selectively increase an effective length of said strap portions.

2. A bib and extension combination assembly comprising:

a panel having a first side, a second side, a bottom edge, a top edge, a first lateral edge and a second lateral edge, said panel having a neck receiving notch therein extending into said top edge and extending towards said bottom edge, a pair of strap portions of said panel being defined between said notch and associated ones of said first and second lateral edges, said strap portions being attachable together and extendable around a neck of a child, at least one fastener being attached to said panel to allow said strap portions to be releasably attached together;

an elongated strap having a first end, a second end, a front side and a backside;

a securing member being attached to said elongated strap and being releasably engageable with said at least one fastener to extend said elongated strap between and releasably secure said elongated strap to each of said strap portions, said securing member including a button attached to said front side of said elongated strap and being positioned nearer to said first end than said second end, said elongated strap having an opening extending into said front side and outwardly of said backside, said opening being positioned nearer to said second end than said first end, said securing member further including a hook and loop securing combination including a first mating member attached to said front side and being positioned adjacent to said first end and a second mating member being attached to said front side and being positioned adjacent to said second end;

an adjustment member being positioned on said elongated strap to selectively alter a length of said elongated strap; and wherein said elongated strap is attached to said strap portions to selectively increase an effective length of said strap portions.

* * * * *